US006383314B1

(12) United States Patent
Dunbar et al.

(10) Patent No.: US 6,383,314 B1
(45) Date of Patent: May 7, 2002

(54) ALUMINUM ALLOY SHEET HAVING HIGH ULTIMATE TENSILE STRENGTH AND METHODS FOR MAKING THE SAME

(75) Inventors: Brady Dunbar, Marienville, PA (US); Kenneth Paul Smith, Mineral Wells, WV (US)

(73) Assignee: Pechiney Rolled Products LLC, Ravenswood, WV (US)

( * ) Notice: Subject to any disclaimer, the term of this patent is extended or adjusted under 35 U.S.C. 154(b) by 0 days.

(21) Appl. No.: 09/593,684

(22) Filed: Jun. 14, 2000

Related U.S. Application Data

(63) Continuation-in-part of application No. 09/208,762, filed on Dec. 10, 1998, now abandoned.

(51) Int. Cl.[7] ..... C22C 21/06
(52) U.S. Cl. ..... 148/440; 420/542; 420/543
(58) Field of Search ..... 148/440; 420/542, 420/543, 544, 545, 546

(56) References Cited

U.S. PATENT DOCUMENTS

| | | | | |
|---|---|---|---|---|
| 4,021,271 A | * | 5/1977 | Roberts | 148/2 |
| 4,851,192 A | * | 7/1989 | Baba et al. | 420/528 |
| 4,968,356 A | | 11/1990 | Tanaka et al. | 148/11.5 |
| 5,062,901 A | | 11/1991 | Tanaka et al. | 148/11.5 |
| 5,240,522 A | | 8/1993 | Tanaka et al. | 148/693 |
| 5,362,341 A | | 11/1994 | Palmer et al. | 148/692 |
| 5,470,405 A | | 11/1995 | Wyatt-Mair et al. | 148/551 |
| 5,480,498 A | | 1/1996 | Beaudoin et al. | 148/549 |
| 5,496,423 A | | 3/1996 | Wyatt-Mair et al. | 148/551 |
| 5,512,111 A | | 4/1996 | Tahara et al. | 148/441 |
| 5,515,228 A | | 5/1996 | Wyatt-Mair et al. | 148/551 |
| 5,518,558 A | | 5/1996 | Shoji et al. | 148/693 |
| 5,540,791 A | * | 7/1996 | Matsuo et al. | 148/549 |
| 5,547,524 A | | 8/1996 | Sainfort et al. | 148/688 |
| 5,578,144 A | | 11/1996 | Satou et al. | 148/415 |
| 5,605,586 A | | 2/1997 | Bekki et al. | 148/549 |
| 5,616,189 A | | 4/1997 | Jin et al. | 148/549 |
| 5,624,632 A | * | 4/1997 | Baumann et al. | 420/544 |
| 5,634,991 A | | 6/1997 | Kamat | 148/551 |

FOREIGN PATENT DOCUMENTS

| | | |
|---|---|---|
| EP | 0506 100 A1 | 9/1992 |
| EP | 0 610 006 A1 | 8/1994 |
| WO | WO 97/11205 | 3/1997 |

OTHER PUBLICATIONS

Metals Handbook: Desk Edition, 2nd Ed., ASM International, 1998, pp. 463–464, 499–500.*

* cited by examiner

*Primary Examiner*—George Wyszomierski
*Assistant Examiner*—Janelle Combs-Morillo
(74) *Attorney, Agent, or Firm*—Heller Ehrman White and McAuliffe

(57) ABSTRACT

Aluminum sheets and methods for manufacturing aluminum sheets are provided. The present invention involves control of processing conditions in order to achieve a fine grain size (i.e. ASTM rating of 8.5 or greater) in the material prior to a final cold working operation. Also included within the scope of the present invention are products having a fine grain size which have strength levels above what can be obtained in 5xxx alloys.

4 Claims, 2 Drawing Sheets

ALUMINUM ALLOY SHEET HAVING HIGH ULTIMATE TENSILE STRENGTH AND METHODS FOR MAKING THE SAME

This application is a continuation-in-part of application Ser. No. 09/208,762 filed Dec. 10, 1998, now abandoned.

BACKGROUND OF THE INVENTION

1. Field of the Invention

The present invention relates to processes for making aluminum sheet and sheets made thereby, and more particularly relates to processes for making high strength, aluminum sheets including magnesium containing aluminum sheets and sheets made thereby involving batch annealing.

2. Description of Related Art

In conventional manufacturing processes for obtaining aluminum sheet, there is generally a trade off between the ultimate tensile strength, magnesium content and elongation of a material. For example increasing the cold work of the sheet generally results in increased ultimate tensile strength with a decrease in elongation. And as a further example, decreasing the cold work generally results in a decrease in ultimate tensile strength with a corresponding increase in elongation. Increasing magnesium content can improve the ultimate tensile strength of the alloy, but typically causes a corresponding increase in the cost of the alloy.

As set out below, flash annealing processes have been developed to address some of the problems that have heretofore been associated with batch annealing, but flash annealing typically requires an additional handling step of unwinding and re-winding, whereas batch annealing does not require this additional handling.

In contrast to the batch annealing process of the present invention, various flash annealing processes, also referred to as continuous annealing processes, have existed and require the additional step of continuously passing the sheet through a heating means as a single web to provide a heat up rate of the sheet at a greatly increased rate over that of batch annealing.

Examples of such flash annealing processes include Palmer et al. U.S. Pat. No. 5,362,341, issued Nov. 8, 1994, which is incorporated herein by reference; and additional continuous annealing processes are disclosed in Tanaka et al. U.S. Pat. No. 5,062,901, issued Nov. 5, 1991; Tanaka et al. U.S. Pat. No. 5,240,522, issued Aug. 31, 1993; Tanaka et al. U.S. Pat. No. 4,968,356, issued Nov. 6, 1990; Wyatt-Mair et al. U.S. Pat. No. 5,470,405 issued Nov. 28, 1995; Wyatt-Mair et al. U.S. Pat. No. 5,496,423 issued Mar. 5, 1996; Wyatt-Mair et al. U.S. Pat. No. 5,514,228 issued May 7, 1996; Tahara et al. U.S. Pat. No. 5,512,111 issued Apr. 30, 1996; Shoiji et al. U.S. Pat. No. 5,518,558 issued May 21, 1996. Satou et al. U.S. Pat. No. 5,578,114 issued Nov. 26, 1996 involves a continuous casting process; Sanford et al. U.S. Pat. No. 5,547,524 issued Aug. 20, 1996 discloses a process for producing a structurally hardened plate involving heating opposite edges at various temperatures; Gen et al. U.S. Pat. No. 5,616,189 issued April, 1997 discloses a process involving flash annealing; Bekki, et al. U.S. Pat. No. 5,605,586 discloses a process involving flash annealing; Kamat U.S. Pat. No. 5,634,991 issued Jun. 3, 1997 discloses a process involving annealing at the rate of heat up at 75 degrees per hour; all of which are incorporated herein by reference in their entireties.

The various flash annealing processes have typically required the additional step of unwinding and re-winding the coil of aluminum sheet. This winding is both time consuming and costly and the aluminum sheet can be damaged in the process, all of which add to the cost of the product. Batch annealing does not require that the aluminum sheet be unwound, and is thus very desirable. However, conventional batch processing has not obtained the desired combination of high ultimate tensile strength for a given level of elongation and magnesium level. For example, strength levels exceeding 448 MPa (65,000 psi) are currently not available in Al—Mg sheet products, as partially shown in the table provided below in the detailed description.

Consequently there is a need and a desire to provide a batch annealing process in the production of aluminum sheet which will provide a high ultimate tensile strength for a given level of elongation and magnesium level. There is also a desire to increase the ultimate tensile strength for a given magnesium level and the elongation percent in order to permit a reduced gauge thickness of sheet made by the present process to effectively perform as a relatively larger conventional gauge thickness of sheet made by a conventional batch annealing process.

SUMMARY OF THE INVENTION

The present invention involves aluminum sheets and methods for manufacturing an aluminum sheet. The present invention further involves control of processing conditions in order to achieve a fine grain size (i.e. ASTM rating of 8.5 or greater) in an aluminum sheet prior to a final cold working operation. Also included within the scope of the present invention are products having a fine grain size which have strength levels above what can be obtained in 5xxx alloys.

Additional objects, features and advantages of the invention will be set forth in the description which follows, and in part, will be obvious from the description, or may be learned by practice of the invention. The objects, features and advantages of the invention may be realized and obtained by means of the instrumentalities and combination particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description of the preferred embodiment given below, serve to explain the principles of the invention.

DETAILED DESCRIPTION OF THE INVENTION

Figure 1:
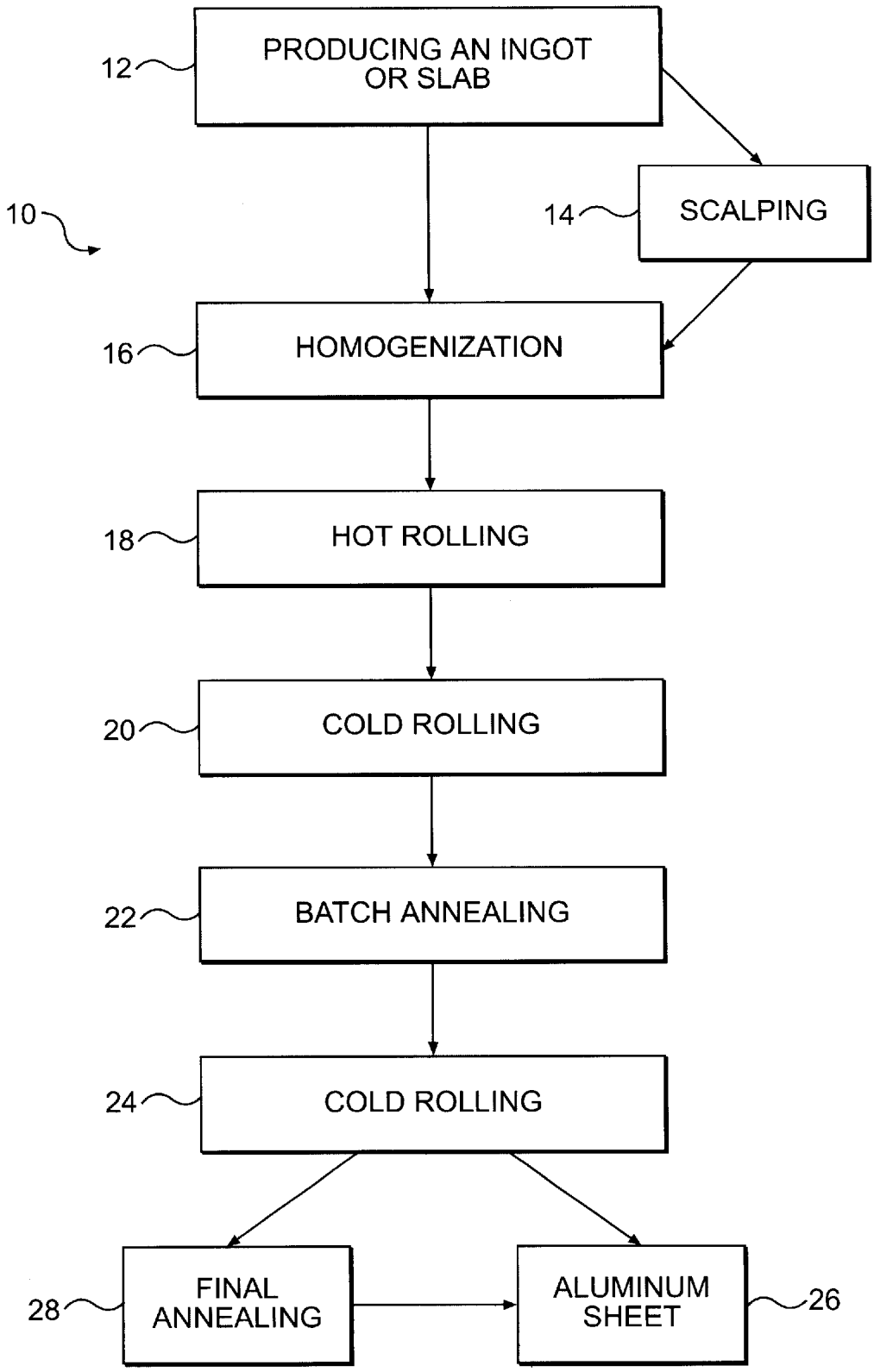
FIG. 1 is a schematic diagram of the process according to the present invention.

The present invention is directed to methods and products wherein strength, formability, warm forming, SPF as well as other properties typically associated with aluminum sheet can be variously obtained depending on the process parameters utilized. These properties are important in various end use applications for aluminum sheet. For example, warm forming is often used in automotive body panels; SPF for aerospace applications. The use of an intermediate anneal with varying degrees of prior cold rolling is employed in aspects of the present invention to achieve desired final products. Materials of the present invention are particularly thought to be useful for any end product that employs low formability/high strength materials, for example, any materials for flat applications such as sign blanks, panels on transportation vehicles, and so on. Materials of the present invention have unexpectedly acceptable 4T bend properties for such a high strength material. In this regard, the prior art generally employs 5xxx alloys for similar end uses, but such 5xxx materials typically have Ultimate Tensile Strength (UTS) values less than 55–60,000 psi. The present materials have UTS values which are higher than 5xxx alloys, but still retain or possess the desired formability requirements.

The processes of the present invention involve batch annealing and produce a sheet exhibiting a high level of ultimate tensile strength (i.e. for a given level of magnesium content and elongation). A typical process involves: (a) producing an aluminum ingot generally comprised of at least 3.0% by weight magnesium based on the total weight of the ingot (mass), (b) homogenizing the ingot, (c) hot rolling the ingot to produce a first intermediate product, (d) cold rolling the first intermediate product to produce a second intermediate product, (e) heat treating the second intermediate product to produce a third intermediate product, and (f) cold rolling the third intermediate product to produce the aluminum sheet. The sheet exhibits a relatively high ultimate tensile strength for a given level of magnesium and a given level of elongation.

A suitable process according to the present invention involves: (a) producing an aluminum ingot (mass) comprising of at least 2.0% by weight magnesium based on the total weight of the ingot (mass), (b) homogenizing the ingot (mass) at a temperature of between 482° C.–649° C. (900° F. and 1200° F.), (c) hot rolling the ingot (mass) at a coiling temperature of between 288° C.–382° C. (550° F. to 720° F.) to produce a first intermediate product, (d) cold rolling the first intermediate product to produce a second intermediate product, (e) batch heat treating (annealing) the second intermediate product at a temperature of at least 316° C. (600° F.) to produce a third intermediate product, (f) cold rolling the third intermediate product to produce said aluminum sheet, and (g) optionally post processing the aluminum sheet by annealing the aluminum sheet at 93° C.–382° C. (200–720° F.). The present invention provides the advantage of a relatively high ultimate tensile strength for a given level of elongation and magnesium thereby permitting higher performance of product for given applications. The high ultimate strength levels are achieved by cold working a fine grain microstructure which is developed in the annealing step (e) subsequent to a minimum of 50% cold working reduction in step (d). The annealing step may be batch annealing or strip annealing. The present process also allows for batch anneal to develop a fine grain microstructure without continuous annealing or flash annealing which typically involves unwinding of coils and additional effort.

An advantageous process according to the present invention is illustrated in FIG. 1 which involves first producing an ingot (12) by the process (10) of the present invention. The ingot may also be referred to as a mass in the event that continuous casting is employed. In the event that an ingot is utilized, the ingot may need to be scalped (14) followed by or prior to preheating (16). After preheating, the product from the preheat step is hot rolled (18) followed by a minimum of 45% cold rolling (20). After cold rolling, the product is then subjected to batch annealing (heat treating) (22) and is then further cold rolled (24) to produce the aluminum sheet (26). The aluminum sheet can be post processed using a final annealing by heating the sheet to 93° C.–382° C. (200–720° F.).

The alloy composition utilized for the ingot (mass) and the alloy sheet of the present invention has a magnesium level of at least 2%, for example 2 to 7% by weight based on the total weight of the composition (ingot, mass, sheet), more preferably a level of 3 to 6% by weight based on the total weight of the composition (ingot, mass, sheet). Supplemental alloy additions in the composition preferably involve manganese at a level of 0.20 to 1.5 weight percent based on the total weight of the composition; silicon at a level of less than or equal to 0.3 weight percent based on the total weight of the composition; iron at a level of less than or equal to 0.4 weight percent based on the total weight of the composition; chromium present at a level of less than or equal to 0.25 weight percent based on the total weight of the composition; zinc present at a level of 1.8 weight percent or less based on the total weight of the composition; scandium present at a level of less than or equal to 0.5 weight percent; zirconium present at a level of less than or equal to 0.5 weight percent; with all other alloy additions being present at a level of less than or equal to 2 weight percent, and preferably all other ingredients being a level of less than 0.2 weight percent individually, with the balance of the composition generally being aluminum.

In a preferred process, an ingot of aluminum is produced by any technique known to one skilled in the art, and is scalped according to any known technique. The ingot (mass) is then preferably homogenized by raising the temperature of the ingot to the range of 482° C. to 649° C. (900° F. to 1200° F.) and generally holding the temperature within that range 482° C. to 649° C. (900–1200° F.) for a time of less than or equal to 30 hours and preferably between 10 and 30 hours. The ingot (mass) temperature is then lowered to the range of 482° C. to 538° C. (900° F. to 1000° F.) and maintained within this range for a time period of at least one hour. Following preheat, the ingot (mass) is preferably hot rolled at a coiling temperature of between 293° C. (560° F.) and 360° C. (680° F.), or more broadly between 288° C. (550° F.) and 382° C. (720° F.), to produce a intermediate product. The hot rolling can be done at any suitable temperature, however, it is desired that the hot rolling temperature be chosen so as to reduce or eliminate the possibility of recrystallization. A suitable initial thickness of the first intermediate product is for example 6.2 mm (0.25").

The first intermediate product is then cold rolled to produce a second intermediate product having a thickness of less than 50% of the thickness of the first intermediate product and more preferably less than 45% of its thickness, and preferably the cold rolling is done at a temperature of less than or equal to 204° C. (400° F.) to produce the second intermediate product. The second intermediate produce is then heat treated by batch annealing.

Batch annealing is accomplished by heating the entire wound coil of aluminum sheet as compared to flash annealing which involves annealing a single layer (web) of the sheet by unwinding the coil and annealing a particular portion of the sheet by passing the sheet through a heat treating station and then re-winding the coil. The present batch annealing avoids the requirement of having to unwind and re-wind the coil.

The annealing (batch annealing) according to the present invention occurs at a temperature of at least 304° C. (580° F.) and preferably above 315° C. (600° F.), and more preferably within the range of 332° C. (630° F.) and 371° C.

(700° F.), for a period of at least two hours to produce a third intermediate product. This product has an average grain diameter of less than 19 microns (ASTM of 8.5 or greater number), for example a grain size of ASTM 11, or more broadly ASTM 8.5 to 12, and for example between ASTM 9 and 11 as measured by ASTM E112. The grain size of 8.5 corresponds to a grain size of about 18.9 microns, consequently, and the grain size are preferably less than 18.9 microns.

Following the batch annealing, the third intermediate product is cold rolled to produce an aluminum sheet having a thickness of from 20 to 80% (preferably 50 to 80%) of the thickness of the second intermediate sheet (a total reduction of 20 to 90%) to produce an aluminum sheet having an ultimate tensile strength of at least 380 MPa [55,000 pounds per square inch-(psi)] as measured by ASTM B557, and typically resulting in an ultimate tensile strength of between 414 MPa (60,000 psi) and 686 MPa (85,000 psi), for example 510 MPa (74,000 psi), and having an elongation of between 4 and 7%.

The present invention also provides high strength alloys without the need for the addition of relatively expensive, excessive levels of strengthening additives, and without the need to impart significant cold work to the product to achieve the strength level. The reduced level of cold work needed to produce such high strength aluminum alloy is in part due to the very fast hardening rate exhibited by the batch annealed sheet (coil) of the present invention when compared with materials of the prior art.

Optionally, a final anneal at for example 93° C. (200° F.) to 382° C. (382° F.) for a time in excess of two hours may be utilized to further increase the formability of the sheet with some sacrifice in the tensile strength.

In more detail, the process for manufacturing an aluminum sheet comprises: (a) producing an aluminum ingot (mass) comprised of at least 2.0% by weight magnesium based on the total weight of the ingot, (b) homogenizing the ingot at a temperature of between 482° C. (900° F.) and 649° C. (1200° F.), (c) hot rolling the ingot at a coiling temperature of between 288° C. (550° F. ) to 382° C. (720° F.) to produce a first intermediate product, (d) cold rolling the first intermediate product to produce a second intermediate product, (e) annealing the second intermediate product at a batch anneal temperature of at least 316° C. (600° F.) to produce a third intermediate product, and (f) cold rolling the third intermediate product to produce a fine grain aluminum sheet. Optionally a final anneal of the aluminum sheet may be performed to increase the elongation properties of the aluminum sheet by annealing the aluminum sheet at a temperature between 93 and 382° C. (200 and 720° F.). In particular, batch anneal of the second intermediate product produces a fine grain; cold working the fine grained material is what imparts substantial high strength properties which were not expected heretofore.

The present method produces an aluminum alloy sheet having 2% or greater magnesium with ultimate tensile strengths in excess of 380 MPa (55,000 psi). A fine grain size, specifically rating 8.5 or greater as measured by ASTM E112 prior to the final cold work is desirable in the processing method in order to enhance the strain hardening characteristics through increasing grain boundary area. Material produced by the present process may find suitable applications such as, but not limited to, flat sheet blanks, boat/ship stock (i.e. boat hulls, etc.), automotive brackets and structural applications.

A suitable chemical composition of material is as follows: no less than 2% by weight magnesium and no more than 6.0% by weight magnesium, no less than 0.20 weight percent manganese and no more than 1.5% by weight manganese, no more than 0.35 weight percent silicon, no more than 0.48 weight percent iron, no more than 0.25 weight percent chromium and no more than 1.8 weight percent zinc; scandium present at a level of less than or equal to 0.5 weight percent; zirconium present at a level of less than or equal to 0.5 weight percent; with additional components each being less than 0.2 weight percent and then the balance being aluminum based on the total weight of the aluminum ingot.

In the preferred process, the ingots are scalped sufficiently to remove cast surface and ingots are prepared for hot rolling. The ingots are then homogenized by heating to a temperature range of 900° F. to 1200° F. (480° C. to 648° C.) and holding (maintaining) the ingots' temperature in this range for up to 30 hours, then cooling to 900° F. to 1000° F. (480° C. to 537° C.) and holding at that temperature for no less than 1 hour prior to hot rolling. The ingots may optionally be hot rolled without the final cooling step.

A suitable process involves, having the slabs hot rolled at a coiling temperature of no less than 299° C. (570° F.) and no greater than 360° C. (720° F.). The coils are then cold rolled to reduce the web thickness by at least 50%. After cold rolling, the coils are heat treated at a temperature of no less than 316° C. (600° F.) for at least 2 hours. During this heat treatment, the fine grains are nucleated, which provides for strengthening during subsequent cold rolling through increasing the strain hardening exponent (or aspect) of the material. The coils are then cold rolled at an additional 50 to 80% to make the final product thickness and take advantage of the increased grain boundary area created during the prior heat treatment.

The maximum strength levels obtained using the present process have generally not been achieved in prior batch processes and are not available in Aluminum-Magnesium sheet alloys. Conventionally, high strengths have been achieved through alloy additions and/or imparting significant cold work of the material with the resultant disadvantages as set out above. For example, an alloy having 4.6% Mg (by total weight) and 0.7–1.0% Mn, with 60% final cold work plus intermediate annealing at 132EC (270EF) for 2 hours according to the present inventive process has a 72 MPa ultimate strength level advantage over the same alloy (4.6% Mg and 0.7–1.0% Mn) cold rolled 80% made according to industry standard practice. (See Example 1 infra.) In another test (Example 2) a 5182 Alloy (commonly used for can lid stock) containing about 4.6% Mg and 0.38% Mn cold rolled about 63% according to the present inventive process has the same strength about 386–400 MPa (56,000–58,000 psi, Ultimate Tensile Strength) as the alloy has cold rolled 80% according to industry standard practice.

The following table shows some additional mechanical property limits of non-heat treatable alloys according to Aluminum Industry standards as described in *Aluminum Standards and Data* (ASD) 1997, published by The Aluminum Association (TAAI) and *Tempers for Aluminum and Aluminum Alloy Products,* February 1995, also published by TAAI. The values set forth herein represent standard strength and elongation properties for known 5××× aluminum alloys.

TABLE 1

| Alloy and Temper | Specified Thickness inches (mm) | Tensile Strengths-MPa (KSI) ULTIMATE (Min) | ULTIMATE (Max) | YIELD (Min) | YIELD (Max) | Elongation (%) |
|---|---|---|---|---|---|---|
| 5086-H38 | 0.006-(0.15 mm) | 324 | | 262 | | 3 |
| | 0.20-(0.5 mm) | (47) | | (38) | | |
| 5154-H38 | 0.006-(0.15 mm) | 310 | | 241 | | 3 |
| | 0.05-(1.25 mm) | (45) | | (35) | | |
| 5154-H38 | 0.051-(1.25 mm) | 310 | | 241 | | 4 |
| | 0.113-(2.8 mm) | (45) | | (35) | | |
| 5154-H38 | 0.114-(2.8 mm) | 310 | | 241 | | 5 |
| | 0.128-(3.2 mm) | (45) | | (35) | | |
| 5086-H18 | 0.006-(0.15 mm) | 359 | 407 | 331 | | |
| (Sheet) | 0.019-(0.47 mm) | (52) | (59) | (48) | | |
| 5086-H19 | 0.006-(0.15 mm) | | | 359 | | 2 |
| (Sheet) | 0.019-(0.47 mm) | | | (52) | | |
| 5086-H191 | 0.006-(0.15 mm) | 373 | | 345 | | 2 |
| (Sheet) | 0.019-(0.47 mm) | (54) | | (50) | | |
| 5086-H39 | 0.006-(0.15 mm) | 359 | | 297 | | 3 |
| (Sheet) | 0.019-(0.47 mm) | (52) | | (43) | | |

As a further step, a final anneal may be performed, the temperature range of the final annealing will depend on the desired properties of the aluminum alloy. To enhance formability, the optional final anneal may be performed, for example, in the range from 93° C. (200° F.) to 380° C. (720° F.) for at least 2 hours. The temperature and time duration for the final anneal will be determined by the level of formability required for the final product. Temperatures above 260° C. (500° F.) will typically be used for 0 temper products and applications requiring an extremely fine grain size, such as super-plastic-forming (SPF). These final anneals will generally reduce the ultimate tensile strength and yield while increasing the elongation.

The instant invention is further directed to methods of achieving very high tensile strengths, i.e. in excess of 55,000 psi, with a non-heat treatable 5××× alloy. Maximum strength levers (above 70 ksi) obtained using this process are not currently available in 5××× alloys. This type of very high strength material is particularly useful for applications where high strength or good dent resistance is important and where very little or no formability is required, such as for highway signs.

Conventional methods for producing high strength levels in 5××× alloys generally involve addition of alloying elements, such as increasing Mg and/or Mn content and imparting significant cold work to the material. The present method involves control of processing conditions in order to achieve a fine grain size (i.e. ASTM rating of 8.5 or greater) in the material prior to a final cold working operation. Also included within the scope of the present invention are products produced according to such methods.

The development of the fine grain microstructure on the product prior to the final cold working operation is desirable, inter alia, since such a fine grain structure enhances the strain hardening characteristics of the material. In other words, with a fine grain size, the material strength increases more rapidly with cold work than a material with a large grain size.

A final annealing operation may be added for applications where some degree of formability is required. Administering a final annealing treatment will lower the strength of the product while concurrently increasing the elongation. However, when a material with very high initial strength level is used i.e. above 55 ksi, the product following the annealing treatment has a very good combination of strength and formability versus 5××× material currently available. This can be beneficial, for example, for use in applications where a 90 degree bend is being performed. Use of the present material would allow down-gauging for example (equal forming characteristics with higher strength versus conventional materials).

The following examples show the increased strength of alloys made according to the present invention. The present examples are intended to explain but not limit the present invention:

EXAMPLE 1

Aluminum Alloy: (All percentages by weight)

4.55% Magnesium
0.98% Manganese
0.01% Copper
0.066% Silicon
0.19% Iron
0.10% Chromium
up to 0.50% Scandium
up to 0.50% Zirconium
<2.0% All others Preheat according to the present invention and hot roll to a thickness of 7.25 mm (0.290") at a temperature of 343° C. (650° F.). Silicon is generally present as an unavoidable impurity in most industrial aluminum products. Silicon and iron are generally present in an amount of 0.40 maximum. The other trace elements that are not necessary to the present invention can be excluded if desired for any reason. This is true for all products according to the present invention.

Process A (Prior Art Step)

80% cold roll aluminum alloy sheet, with no intermediate annealing.

Resulting Ultimate Tensile Strength: 438 MPa (63.500 psi)

OR

Process B (According to Present Invention) Cold roll aluminum alloy sheet to 2.5 mm (0.100O) (60% cold work) and anneal at 93–382EC (200–720EF) for 2 hours.

Additional 60% cold roll to 1 mm (0.0400).

Resulting Ultimate Tensile Strength: 510 MPa (74,000 psi)

The Example shows the alternative finishing steps for the alloy. The Process A, which was practiced in prior art methods, concludes with a cold rolling and no final anneal where it is shown that 80% cold work with no intermediate anneal results in an UTS of 438 MPa. Process B, according to the present invention, uses an intermediate or batch anneal after prior cold work to develop a fine grain size. Cold working the fine grain material an additional 60% obtains a material with an UTS of 510 Mpa.

As shown in the above example, completing the processing by 80% cold rolling the aluminum sheet to 80% of its thickness, with no intermediate annealing, results in a sheet having a Ultimate Tensile Strength (UTS) of about 438 MPa (63,500 psi). A sheet processed according to the current invention which has been 60% rolled and then annealed at 260–382EC (500–720EF) for 2 hours and cold rolled 60% again has a much higher UTS of 510 MPa (74,000 psi). This increased strength is significantly higher than a similar alloy processed according to prior art processes.

EXAMPLE 2

Aluminum Association alloy 5182 (commonly used for beverage can lids) [comparable to the composition of Example 1, except Manganese is 0.4%]

Process A (Prior Art Step): Preheat and hot roll mass as described in the detailed description. Hot roll sheet to 2.87 mm (0.1150) at 332EC (630EF). Cold roll 86% to 0.4 mm (0.016O).

Resulting Ultimate Tensile Strength: 386–400 MPa (56,000–58,000 psi)

OR

Process B:

(According to the Present Invention) Same as Process A, but cold roll 62% to 1.1 mm (0.043O) sheet thickness. Batch anneal sheet at 332EC (630EF)

Cold roll 63% to 0.4 mm (0.016O)

Resulting Ultimate Tensile Strength: 386–400 MPa (56,000–58,000 psi)

Here again, an alloy sheet processed using a cold rolling step of 86% cold work following the hot rolling results in a UTS of 386–400 MPa (56,000–58,000 psi) for the alloy 5182 used for beverage can lids. The batch anneal of this process allows cold rolling to be used to roll the sheet to the final thickness of 0.4 mm (0.016") while maintaining the same UTS by increasing the formability of the alloy through annealing. That is, Process B, according to the present invention obtains the same strength level of 56,000–58,000 psi, with only 63% final cold work. In other words, much less final cold work is necessary or required to achieve the same properties and strength levels as the prior art.

EXAMPLE 3

Same alloy as in example 1.

Preheat according to the invention and hot roll to a thickness of 7.25 mm (0.290") at a temperature of 343 C. (650 F.).

Process A (Prior Art)

78% cold rolling with no final annealing.

Resulting UTS: 453 MPa (65,600 psi)

YS (60,400 psi)

Elongation 4.4%

Process B (Invention)

55% cold rolling and annealing at 132 C. (270 F.) for 2 hours, developing a fine grain structure.

Resulting UTS: 475 MPa (68,800 psi)

YS: 426 MPa (61,700 psi)

Elongation: 5.5%

The process which includes both a batch anneal and a final anneal provides a greater elongation over prior art and better mechanical resistance.

Process B shows a 5% increase in UTS and a 25% increase in elongation of prior art Process A. As much as a 50% increase in UTS may be possible.

EXAMPLE 4

Same alloy and hot rolling as in example 3.

Process A

78% cold rolling with no final annealing. The cold rolled sheet is transformed by superplastic forming (SPF)

Resulting SPF elongation: 375%

Process B

55% cold rolling after annealing at 132° C. for 2 hours to develop a fine grain structure Resulting SPF elongation: 375%

The process of the invention provides the same SPF elongation with significantly less cold work.

EXAMPLE 5

End Use: Sign Blanks (i.e. Highway Signs) Produced according to Example 1 Current commercial standard material for sign blanks is 5052-H38, Replacement with the instant product would allow significant improvement in dent resistance and/or reduction in thickness. Dent resistance is related to the product of the material yield strength (YS) and the square root of the material thickness (T).

a. Increased Dent Resistance:

Current Commercial Product 5052-H38 yield strength is typically 32 ksi

Typical Thickness=0.080 inches $YS*T^{1/2}=9.05\ ksi*in^{1/2}$

Instant Product yield strength=60 ksi

For equivalent thickness of 0.080 inches $YS*T^{1/2}=16.97\ ksi*in^{1/2}$

This data confirms that there was an 87% increase in dent resistance at the same thickness level here of 0.080". Large increases in dent resistance of the same scope shown here would be expected in aluminum sheets of any thickness and could be calculated by those of skill in the art using known techniques. As is apparent by the formula, the increase in dent resistance would be related to the original thickness of the material.

b. Thickness (Weight) Reduction

To maintain a constant dent resistance; based on the product of the material yield strength and the square root of the material thickness:

A 5052-H38 sign blank product has a dent resistance of 9.05 $ksi*in^{1/2}$; replacing this material with the instant sign blank material at a YS=60 ksi, a thickness of 0.0227" could be used. Thus, there is a thickness reduction of 71.6%, while maintaining equivalent dent resistance.

EXAMPLE 6

End Use: Improved Impact Energy (i.e. Tankers for Hauling Dangerous Goods) Priority according to Example 3 (%EL)

Instant product offers high value in terms of ultimate tensile strength (UTS) and percent elongation which are a factors used in determining the thickness requirements i.e. for tankers hauling dangerous goods.

When replacing steel with aluminum for such end uses, the following formula is typically used to determine the necessary aluminum thickness:

$$T_{st}=(21.4*T_{Al})(UTS*\%EL)^{1/3}$$

The following table compares the UTS*%EL for standard 5083 material produced with conventional methods (cold work) versus the instant product produced according to Example 3, but with two different final annealing temperatures.

| Fabrication Method | Straight Cold Work | Fine Grain Roll (270° F.) | Fine Grain Roll (400° F.) |
|---|---|---|---|
| Product UTS | 65.5 ksi | 68.8 ksi | 58.5 ksi |
| Product % El | 4.4% | 5.5% | 8.1% |
| UTS* % El | 288.2 | 378.4 | 473.85 |

EXAMPLE 7

Material produced via the instant method lends itself to obtaining a very good combination of high ductility and high strength in warm forming applications. Below is an example of a plain strain value from a forming limit diagram along with a corresponding minimum ultimate tensile strength value at a warm forming temperature of 250° C.

Forming Temperature=250° C.

Plane Strain=100%

Minimum UTS=40 ksi

It is also possible to employ increasingly higher UTS values (i.e. 42 ksi, 44 ksi, 46 ksi, 48 ksi, 50 ksi, 52 ksi, 54 ksi, and even up to 60 ksi or higher).

Figure 2:
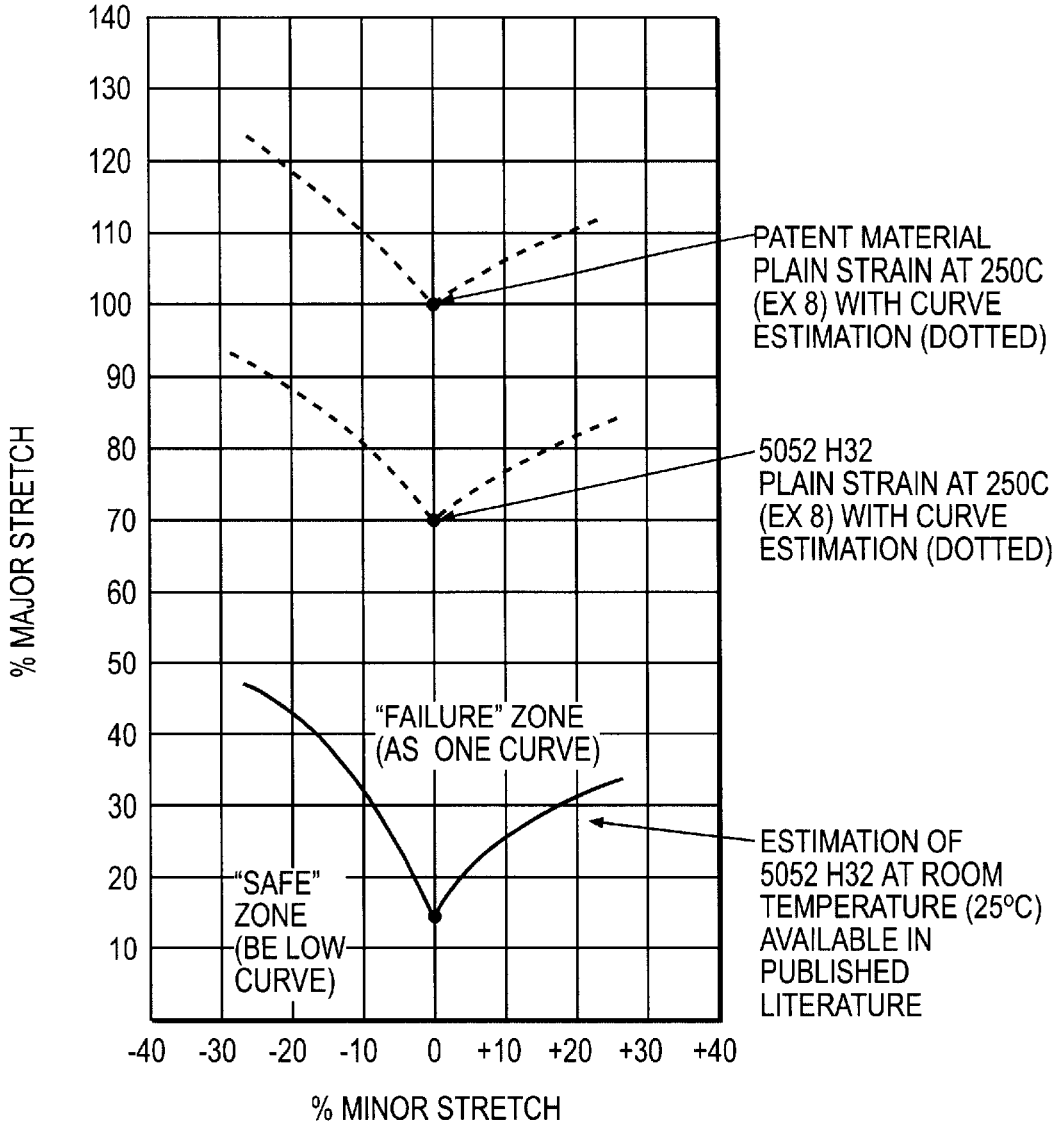
FIG. 2 is a Form Limiting Diagram (FLD) according to an embodiment of the present invention.
Figure 2A:
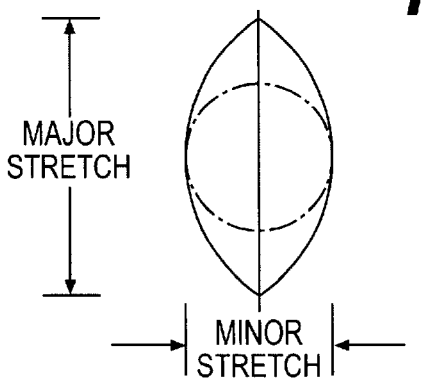
FIG. 2A shows details of a grid circle of major stretch and minor stretch from FIG. 2.
Figure 2B:
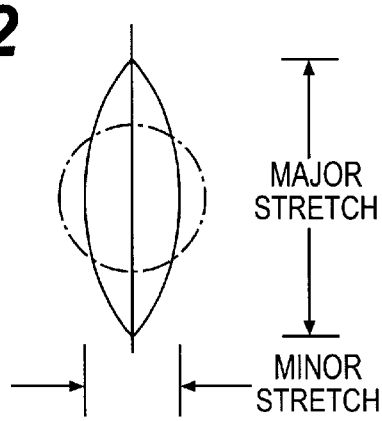
FIG. 2B shows details of a grid circle of major stretch and minor stretch from FIG. 2.

As shown, for example, in FIG. 2, grid circles etched onto sheets are analyzed after forming. Major and minor stretch values are measured according to circles shown. These vectors comprise a curve called a Forming Limit Diagram (FLD) shown at the bottom of FIG. 2.

Strain paths which result below the curve are generally referred to by those of skill in the art as "safe" because they may be performed with no necking or fracture. "Above the curve" strain paths are avoided due to potential failure. In terms of formability, it is desirable for the curve to be shifted higher on the graph if possible.

Also shown in FIG. 2 is an estimated room temperature curve for 5052 H32, as well as "plain strain" data points (at 0% minor stretch) for the material according to the present invention and 5052 H32 at 250° C. Plain strain is important to designers because it is the lowest point on the curve. Repeatedly the instant material's plain strain value is much larger than 5052H32 (100% vs. 70%) despite 5052 H32 elongation at room temperature being much higher (10% to 4%), for example.

The remainder of the FLD curve could be constructed according to known techniques and would be similar in shape to the curve shown in FIG. 2.

EXAMPLE 8

High strength (before warm forming)→70 ksi UTS

Plus

High Plain Strain Elongation during warm forming=100% (as above)

This is versus a typical material 5052 H32 which has much higher room temperature elongation (i.e. 10% versus 4%) but much lower strength, about half (34 ksi versus 70 ksi). Thus, the instant product possesses are substantially higher (nearly 150%) strength and 50% of the room temperature RT elongation when compared with conventional materials such as 5052 H32, but has 100% warm forming plane strain value versus 5052 H32 warm forming plain strain value of about 70%. The UTS of 5052 H32 generally ranges from 31–38,000 psi.

| 5052-H32 | | Inventive Material according to example 7: | |
|---|---|---|---|
| UTS (room temp): | 34 ksi | US (room temp) | 70 ksi |
| % El (room temp): | 10% | % El (room temp) | 4% |
| Plain Strain % Elg (250 C.): | 70% | Plain Strain % El (250 C.): | 100% |

What is claimed:

1. An aluminum alloy sheet comprising:

from 4.55 to 6% by weight magnesium based on the total weight of the sheet;

at least 0.98% manganese by weight;

up to 0.3% by weight silicon;

up to 0.4% by weight iron;

up to 0.25% by weight chromium;

up to 0.50% by weight Scandium;

up to 0.50% by weight Zirconium; and less than 2% by weight total of other alloying elements and impurities, said sheet having an ultimate tensile strength of at least 469 MPa (68,000 psi) as measured by ASTM B557.

2. An aluminum sheet material comprising (a) from 4.55 to 6% by weight magnesium based on the total weight of the sheet;

(b) at least 0.98% manganese by weight;

(c) less than 3% total by weight of other alloying elements and impurities; said sheet having an ultimate tensile strength of at least 469 MPa (68,000 psi) as measured by ASTM B55, and having an SPF elongation of more than 350%.

3. An aluminum alloy sheet that has been formed by cold rolling an aluminum material having an average grain size of at least 8.5 as measured by ASTM E112, said aluminum alloy sheet comprising:

(a) from 4.55 to 6% by weight magnesium based on the total weight of the sheet;

(b) at least 0.98% manganese by weight;

(c) less than 3% total by weight of other alloying elements and impurities; said sheet having an ultimate tensile strength of at least 469 MPa (68,000 psi) as measured by ASTM B557.

4. An aluminum alloy sheet comprising:

from 4.55 to 6% by weight magnesium based on the total weight of the sheet;

at least 0.98% manganese by weight;

up to 0.3% by weight silicon;

up to 0.4% by weight iron;

up to 0.25% by weight chromium;

up to 0.50% by weight Scandium;

up to 0.50% by weight Zirconium; and less than 2% by weight total of other alloying elements and impurities, said sheet having an ultimate tensile strength of at least 469 MPa (68,000 psi) as measured by ASTM B557, wherein said other alloying elements and impurities are each present at a level of not more than 0.2% by weight individually.

* * * * *